US005815972A

United States Patent [19]

Anderson

[11] Patent Number: 5,815,972

[45] Date of Patent: Oct. 6, 1998

[54] REVOLVER

[76] Inventor: Nigel Iivari Anderson, Afgen House, 26 Kyalami Boulevard, Kyalami Business Park, Midrand, South Africa

[21] Appl. No.: 682,652

[22] PCT Filed: Nov. 28, 1995

[86] PCT No.: PCT/GB95/02778

§ 371 Date: Aug. 27, 1996

§ 102(e) Date: Aug. 27, 1996

[87] PCT Pub. No.: WO96/17217

PCT Pub. Date: Jun. 6, 1996

[30] Foreign Application Priority Data

Nov. 28, 1994 [ZA] South Africa ..... 94/9435

[51] Int. Cl.[6] ..... F41A 19/52; F41C 23/12

[52] U.S. Cl. ..... 42/65; 43/71.02; 43/103; 43/72; 43/100

[58] Field of Search ..... 42/59, 63, 64, 42/65, 67, 71.02, 71.01, 75.02, 103, 72, 100; 89/1.41, 1.42

[56] References Cited

U.S. PATENT DOCUMENTS

| | | | |
|---|---|---|---|
| 528,263 | 10/1894 | Smith | 42/59 |
| 529,877 | 11/1894 | Picard | 42/59 |
| 1,047,054 | 12/1912 | Holmes | 42/59 |
| 1,436,536 | 11/1922 | Russell et al. | 89/1.42 |
| 2,899,767 | 8/1959 | Boudreau . | |
| 3,651,593 | 3/1972 | Clark | 42/65 |
| 4,019,273 | 4/1977 | Kibler et al. | 42/84 |
| 4,109,559 | 8/1978 | Davis | 42/71.01 |
| 4,159,670 | 7/1979 | Turner | 89/155 |
| 4,630,387 | 12/1986 | Crane et al. | 42/73 |
| 5,042,186 | 8/1991 | Bechtel | 42/103 |
| 5,177,309 | 1/1993 | Willoughby et al. | 42/103 |
| 5,279,061 | 1/1994 | Betz et al. | 42/103 |
| 5,299,375 | 4/1994 | Thummel et al. | 42/103 |

FOREIGN PATENT DOCUMENTS

| | | | |
|---|---|---|---|
| 0 028 590 | 5/1981 | European Pat. Off. . | |
| 2483595 | 12/1981 | France . | |
| 2 507 762 | 12/1982 | France . | |
| 512795 | 2/1955 | Italy | 42/59 |
| 10866 | 7/1895 | Switzerland . | |
| 243368 | 7/1946 | Switzerland . | |

*Primary Examiner*—Stephen M. Johnson
*Attorney, Agent, or Firm*—Bell Seltzer Intellectual Property Law Group of Alston & Bird LLP

[57] ABSTRACT

The invention concerns a handgun which comprises a trigger (42), a firing mechanism arranged to be actuated by the trigger and to fire a cartridge, a barrel (4) through which the bullet of the cartridge is projected when the cartridge is fired and a butt (60) which is arranged to be gripped in the hand of a user. The axis (57) of the barrel, and hence the line of action of a recoil force which is generated when the cartridge is fired, is at least substantially aligned with the line of action of a resisting force applied to the handgun by the use's hand. Also, the trigger is located above the axis of the barrel.

6 Claims, 12 Drawing Sheets

REVOLVER

BACKGROUND TO THE INVENTION

THIS invention relates to handguns, both of revolver and pistol type.

A disadvantage of all known handguns is that of upward jerking of the weapon when a shot is fired. FIG. 1 illustrates a conventional revolver gripped in the normal way in the hand. In this Figure, the numeral 101 indicates the normal reaction force resulting from the projection, at high velocity, of a bullet through the barrel of the gun. The recoil which arises on firing is resisted both by the inherent inertia of the weapon and by the hand of the shooter. The numeral 102 indicates the resisting force applied by the shooter's hand. The design of conventional handguns, such as that illustrated in FIG. 1, requires that the shooter grip the weapon at a position below the line of the reaction force 101. Thus the line of action of the force 102 is parallel to but below the Line of action of the force 101. The combined effect of the forces 101 and 102 is to create a turning moment, indicated diagrammatically by the numeral 103, which causes an upward jerking movement of the gun, indicated by the numeral 104.

The upward jerking movement 104 is magnified as a result of the fact that in the conventional design as illustrated, there is a substantially greater mass of the gun located below the line of action of the force 101 than above it. An additional factor which increases the tendency of the weapon to jerk upwards when a shot is fired is the fact that the reaction force on the hand, i.e. a force equal and opposite to the force 102, acts in a line above the wrist axis 105 about which the hand is substantially free to pivot relative to the forearm. This in turn gives rise to an anticlockwise turning moment about the wrist corresponding to upward jerking movement of the handgun.

The upward jerking movement each time a shot is fired requires re-alignment of the weapon before the next shot can be fired accurately. Proper re-alignment requires a considerable degree of skill on the part of the user and is time-consuming. This considerably limits the effectiveness of known handguns in situations where multiple shots are to be fired in close succession.

SUMMARY OF THE INVENTION

According to the present invention there is provided a handgun which comprises a trigger, a firing mechanism arranged to be actuated by the trigger and to fire a cartridge, a barrel through which the bullet of the cartridge is projected when the cartridge is fired, the barrel having an axis, and a butt which is arranged to be gripped in the hand of a user, wherein the axis of the barrel, and hence the line of action of a recoil force which is generated when the cartridge is fired, is at least substantially aligned with the line of action of a resisting force applied to the handgun by the user's hand when the butt is gripped normally, and furthermore wherein the trigger is located above the axis of the barrel.

The alignment of the action and reaction forces in this way substantially reduces the tendency of the handgun to jerk upwardly when fired. In addition, the mounting of the trigger above the axis of the barrel allows for a layout with desirable weight distribution characteristics In some cases where the lines of action and reaction are not perfectly aligned it is preferred that the axis of the barrel be located very slightly below the line of action of the resisting force. This feature further reduces the tendency of the weapon to jerk upwardly when fired by producing a counter-moment opposing the moment acting about the pivot axis of the wrist.

Preferably also, the centre of inertia of the handgun is located substantially on or just above the axis of the barrel, thereby further reducing the tendency for the weapon to jerk upwardly when fired.

The handgun may be a revolver comprising a hammer which is arranged to cause movement of a firing pin in a direction to cause firing of a cartridge and which is carried by a spring loaded hammer shaft actuated by the trigger. In this case, the preferred layout is one in which the hammer shaft lying on an axis below the trigger and substantially coincident with the line of action of the resisting force.

The handgun may alternatively be an automatic pistol. In this case, a simple design is obtained, with minimal modification of a conventional pistol, if the pistol includes a trigger mechanism comprising a lever arranged to be pivoted by the trigger, a pivotal disconnector which is arranged to initiate the firing of a cartridge, and a mechanism arranged to transmit pivotal movement of the lever to the disconnector, thereby to cause the disconnector to initiate the firing of the cartridge. In its simplest form the mechanism comprises a cable attached to the lever and to the disconnector.

According to another preferred feature of the invention, the butt is inclined relative to the axis of the barrel at such an angle that the axis of the barrel passes substantially through the wrist joint of a user holding the butt in normal manner. This feature also reduces the tendency of the weapon to jerk upwardly when fired.

In sophisticated versions of the invention, there may be a laser tube or laser diode arranged to project a laser beam parallel to the axis of the barrel, or at an inclination thereto, to facilitate aiming.

Accurate aiming can also be achieved with a handgun comprising a front sight on the barrel, a rear sight located towards the rear of the handgun, the front sight being located beneath the rear sight, and an arrangement of reflectors arranged to provide an aiming line close to the axis of the barrel and passing through the front and rear sights.

BRIEF DESCRIPTION OF THE DRAWINGS

As described above, FIG. 1 shows a conventional revolver and illustrates the main reason for upward jerking of the weapon when a shot is fired The invention will now be described in more detail, by way of example only, with reference to the accompanying drawings in which:

FIG. 3 shows a modification of de revolver seen in

DESCRIPTION OF EMBODIMENTS

Figure 1:
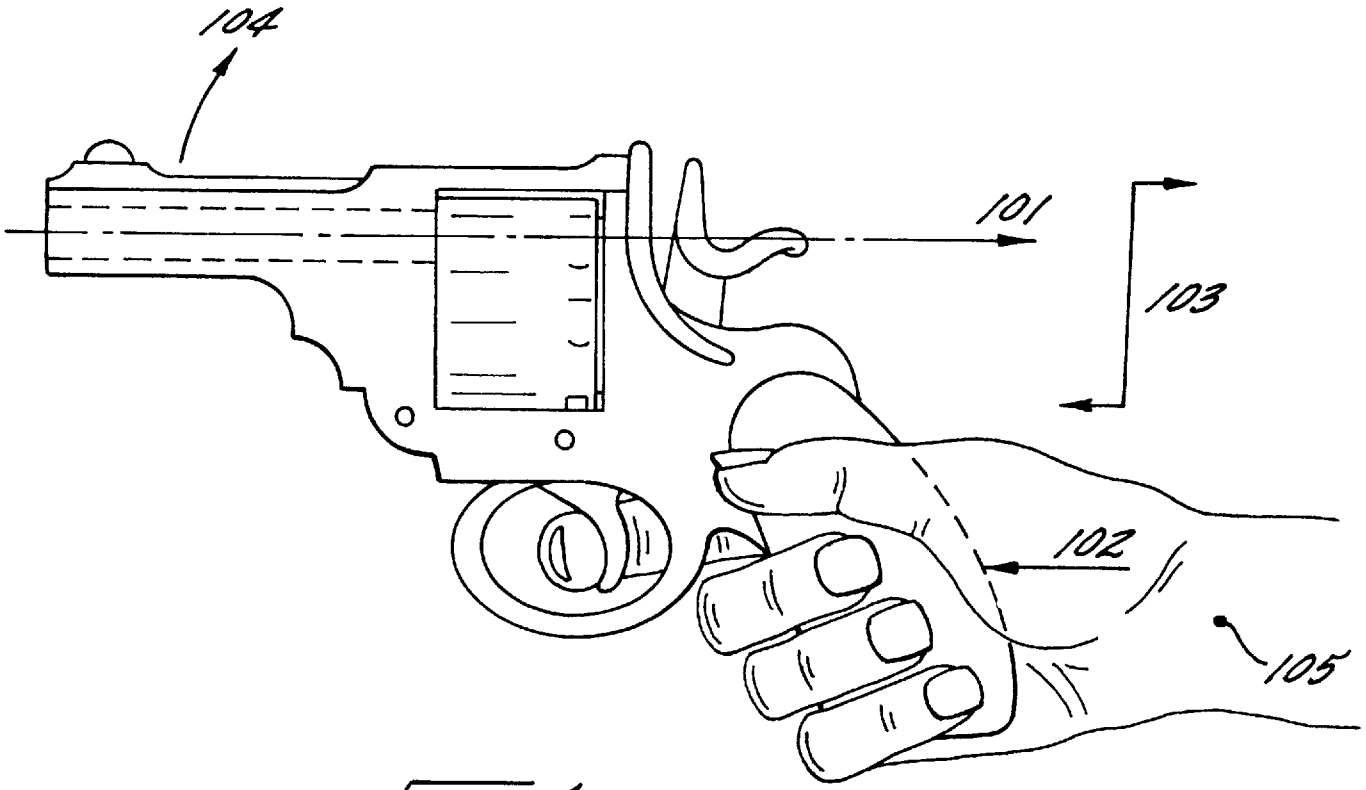
FIG. 1. (PRIOR ART)
Figure 2:
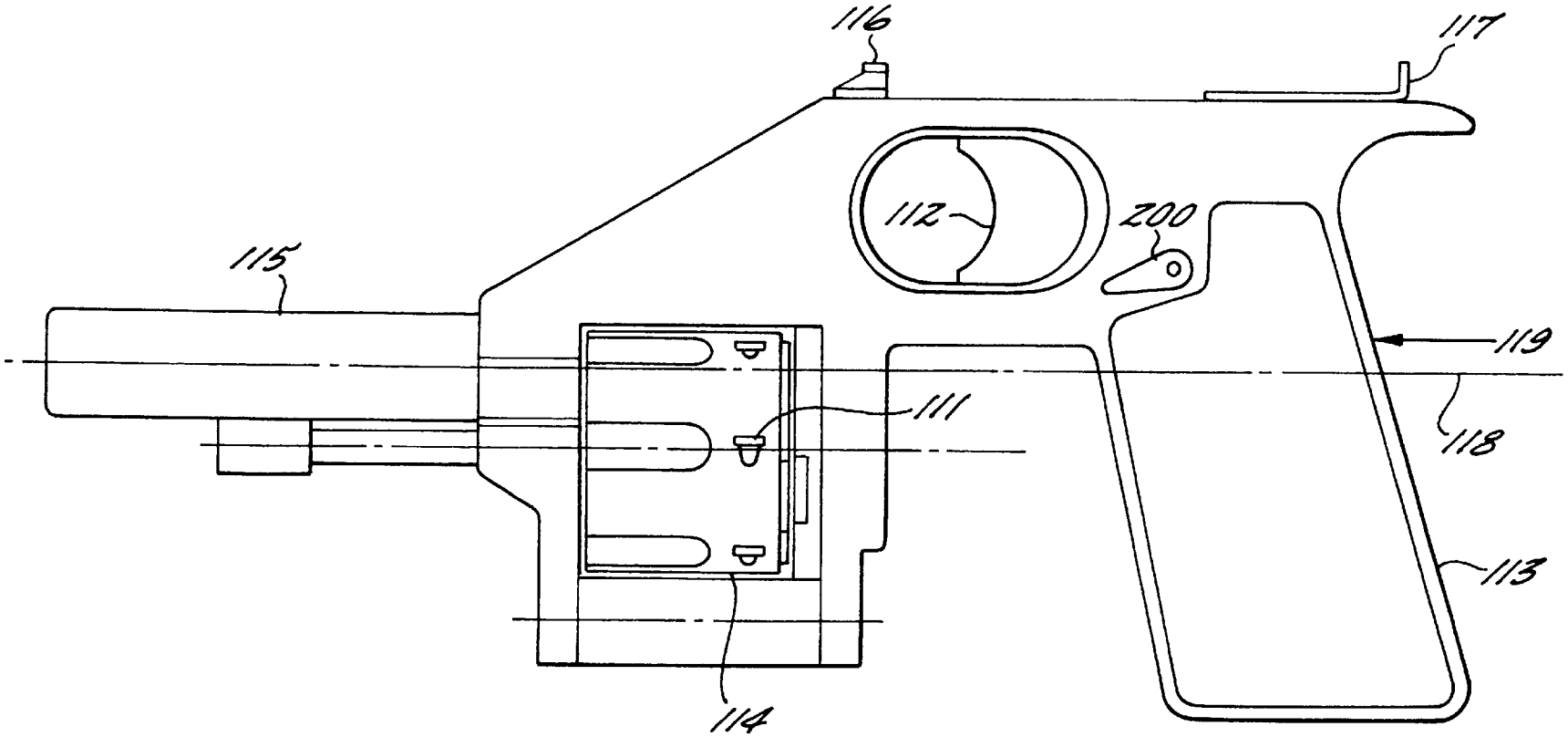
FIG. 2 illustrates a revolver according to the invention and is used to explain the underlying principles of the invention.

FIG. 2 illustrates the principles underlying the present invention as applied to a revolver 110. In this Figure, the numerals indicate the following:

111. locator slots
112. the trigger of the revolver
113. the butt
114. the cartridge cylinder
115. the barrel
116. the front sight
117. the rear sight
118. the centre line of the barrel
119. the line of action of the resisting force applied by the user's hand when the butt is gripped in normal manner.

When a shot is fired from the revolver 110, the reaction or recoil force acts to the rear, i.e. to the right, along the line 118. The resisting force applied by the hand of the user is along the line 119 which is substantially coincident with the line 118. Thus the action and reaction forces are substantially in alignment and the creation of a turning moment which would tend to jerk the weapon upwardly is at least largely eliminated.

It will be noted in FIG. 2 that the line 118, along which the recoil or reaction force attributable to the firing of the weapon acts, is in fact slightly below the line 119 along which the resisting force applied by hand to the weapon acts. Thus in this specific arrangement, there is a slight tendency to the creation of an anticlockwise turning moment, which would in turn give rise to a slight tendency for the weapon to dip downwardly. This counteracts the above-described anticlockwise turning moment about the wrist axis and further reduces the upward jerking movement of the weapon.

Another feature of the revolver which will be apparent from FIG. 2 is the orientation of the butt 113 relative to the line 118. As illustrated, the butt is arranged at a more acute angle to the line 118 than would be the case with conventional handguns. The arrangement of the butt is such that the line 118 passes as near as possible through the pivotal centre of the wrist joint, once again reducing the tendency for the weapon to jerk upwardly when fired.

The objective of limiting the tendency of the weapon to jerk upwardly is furthermore limited by the fact that the weapon seen in FIG. 2, and described in more detail in FIGS. 4 to 11, is designed such that its centre of inertia is above, rather than below, the line 118, i.e. above the centre line of the barrel 115. An important feature of the revolver of FIGS. 2, 3 and 4 to 11 is the fact that the trigger 112 and the majority of the associated actuating components are located above the line 118.

Figure 4:
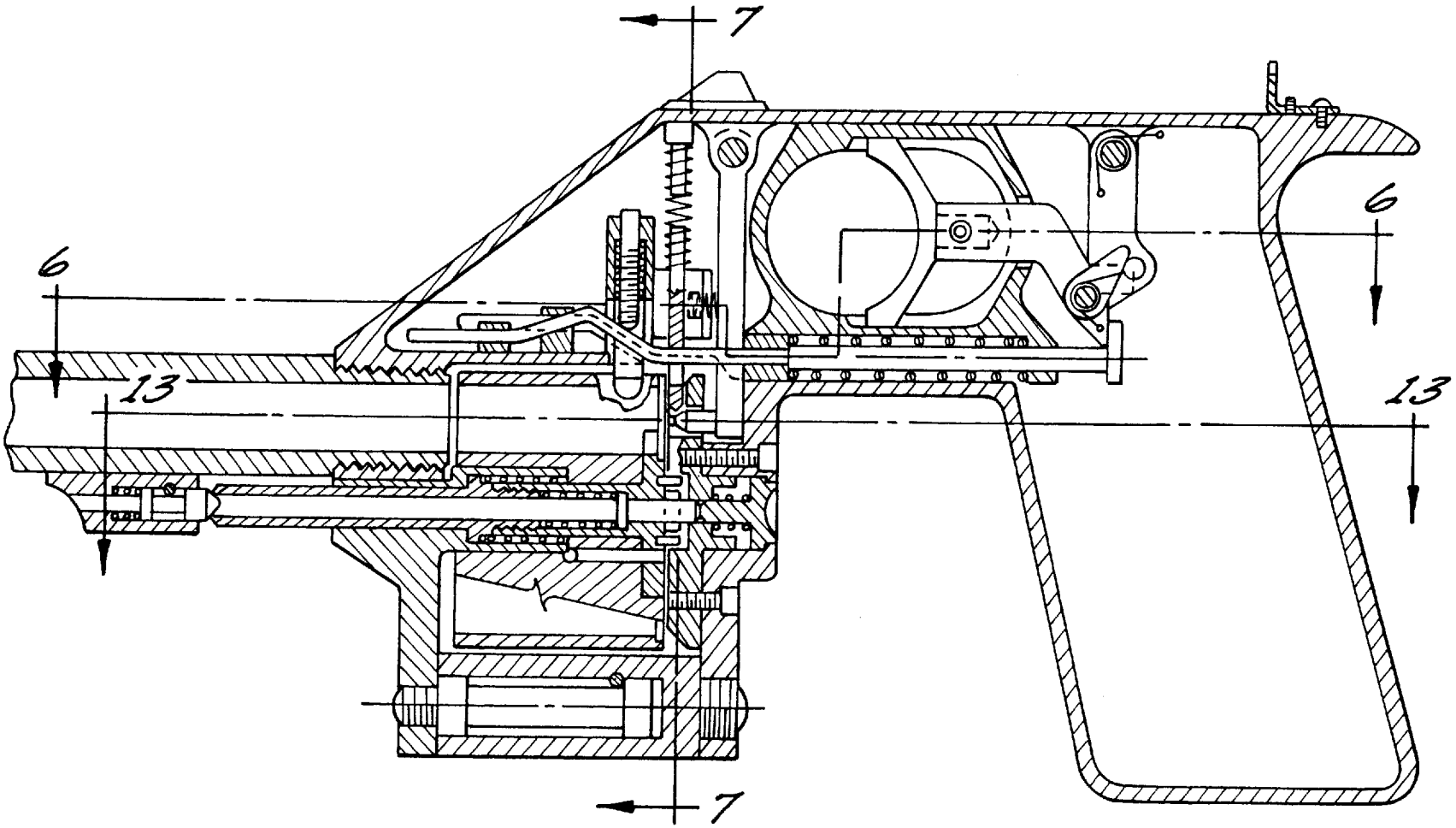
FIGS. 4 and 5 show detailed cross-sectional views of a revolver, such as that seen in FIG. 2, with FIG. 5 including reference numerals.
Figure 5:
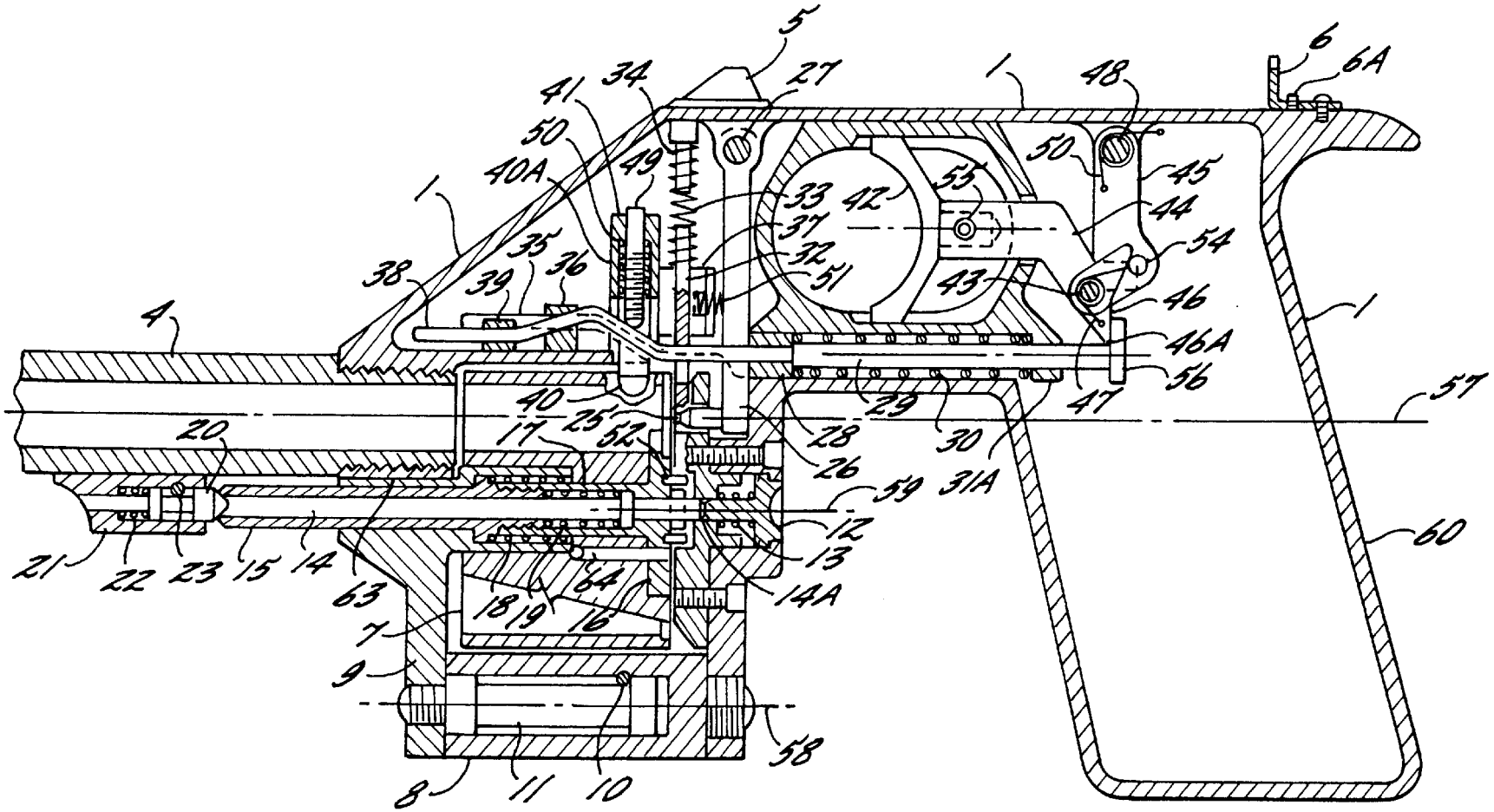

FIG. 4 shows a cross-sectional view of a revolver which embodies the principles described above with reference to FIG. 2. FIG. 5 shows the same revolver and includes reference numerals used in the following detailed description. In FIGS. 5 to 11, the reference numerals and letters indicate the following:

| | |
|---|---|
| 1. | Frame |
| 2. | Left side plate |
| 3. | Right side plate |
| 3A. | Surface sliding area for pawl 32 |
| 4. | Barrel |
| 5. | Front sight |
| 6. | Rear sight |
| 6A. | Rear sight elevation screw |
| 7. | Cylinder |
| 8. | Yoke journal |
| 9. | Yoke |
| 10. | Yoke retaining pin |
| 11. | Yoke pivot shaft |
| 12. | Cylinder latch button |
| 13. | Cylinder latch button spring |
| 14. | Centre pin |
| 14A. | End portion of pin 14 |
| 15. | Extractor rod |
| 16. | Extractor head |
| 17. | Extractor body |
| 18. | Cylinder retainer spring |
| 19. | Centre pin retainer spring |
| 20. | Locking bolt |
| 21. | Locking bolt housing |
| 22. | Locking bolt spring |
| 23. | Locking bolt pin |
| 24. | Recoil disc |
| 24A. | Curved solt |
| 24B. | Slot for pawl 32 |
| 24C. | Centre hole |
| 25. | Firing pin |
| 26. | Firing pin bar |
| 27. | Firing bar pivot pin |
| 28. | Hammer |
| 29. | Hammer shaft |
| 30. | Hammer spring |
| 31. | Trigger frame |
| 31A. | Hammer shaft guide |
| 32. | Pawl |
| S. | Contact point of pawl 32 |
| T. | Contact and pivot point of pawl 32 |
| 33. | Pawl spring |
| 34. | Pawl spring anchor point |
| 35. | Pawl actuating shaft |
| 36. | Pawl shaft guide |
| 37. | Pawl guide |
| 38. | Locator actuating shaft |
| 39. | Locator shaft guide |
| 40. | Cylinder locator |
| 40A. | Cylinder locator upper |
| 41. | Cylinder locator guide |
| 42. | Trigger |
| 43. | Trigger link pin |
| 44. | Trigger extension |
| 45. | Trigger link lever |
| 46. | Hammer actuating lever |
| 46A. | Lever end |
| 47. | Hammer lever spring |
| 48. | Trigger link pivot pin |
| 49. | Locator adjustment screw |
| 50. | Locator spring |
| 51. | Firing pin bar rebound |
| 52. | Sprocket pins |
| 53. | Trigger return spring |
| 54. | Actuating lever stop |
| 55. | Spring pin |
| 56. | Hammer shaft head |
| 57. | Firing centre line |
| 58. | Cylinder assembly pivot |
| 59. | Cylinder centre line |
| 60. | Butt |
| 61. | Safety lock |
| 62. | Safety lever |
| 63. | Meeting surface between frame 1 and yoke 9 |
| 64. | Extractor body key |
| 65. | Sprocket wheel |

Various operations of the revolver are described hereunder with reference to the drawings and the above list of reference numerals and letters.

When the trigger 42 is pulled rearwardly, its movement is transmitted by the trigger extension 44 and link p in 43 to the trigger link lever 45 which swings in an anticlockwise direction about the trigger link pivot pin 48. This action also moves the hammer actuating lever 46, and in particular the end 46A thereof, to the rear along an arcuate path centred on the pivot pin 48.

Figure 11:
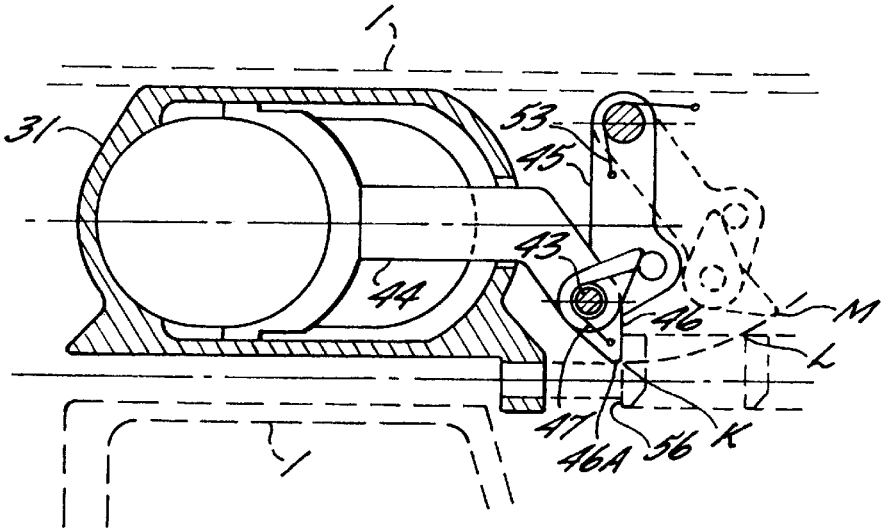
FIG. 11 illustrates the trigger system of the revolver at an enlarged scale.

The end 46A of the lever 46 acts against the enlarged hammer shaft head 56 at a point K (FIG. 11). This pulls the hammer assembly, comprising the head 56, shaft 29, hammer 28, pawl actuating shaft 35 and locator actuating shaft 38, to the right as viewed in FIG. 4. This movement compresses the hammer spring 30 until such time as the lever end 46A swings clear of the shaft head 56. At this stage, the hammer assembly is released by the lever 46 and is projected forwardly with considerable force and momentum, under the influence of the spring 30.

The hammer 28, carried by the leading or forward end of the shaft 29, strikes the firing pin bar 26 with considerable momentum. The firing pin bar swings in a clockwise direction about the firing pin bar pivot pin 27 and accelerates the firing pin 25, carried at the end of the bar 26, in a forward direction, i.e. to the left. During this movement of the firing pin bar 26, the rebound spring is compressed. The firing pin impacts on the percussion cap of a cartridge (not illustrated) located in the relevant cartridge cavity of the cylinder 7, and fires it.

After firing has taken pace, the firing pin bar 26 and the hammer assembly as a whole are returned to their pre-firing positions by the action of the rebound spring 51. At this stage, with the spring 30 virtually filly extended, the spring force of the spring 51 is sufficient to overcome the spring force of the spring 30.

The cartridge cylinder 7, which in the illustrated embodiment includes six cartridge cavities, i.e. the revolver is a six shot revolver, is automatically indexed into position for the firing of the cartridge in the next cartridge cavity in the following manner. When the trigger 42 is pulled, the hammer assembly moves to the right as explained above. This simultaneously draws the pawl actuating shaft 35 and the locator actuating shaft, which are connected to the hammer 28 (FIGS. 5 and 6), to the right through the same distance. As illustrated in FIG. 5, the shaft 38 includes upwardly and downwardly inclined portions defining an inverted V-shape and is in contact with the locator adjustment screw 49 and hence with the downwardly projecting cylinder locator 40. As the shaft 38 moves to the right when the trigger 42 is pulled, the upwardly inclined portion thereof acts as a cam and urges the screw 49 and locator 40 upwardly against the bias of the locator spring 50. The locator 40 moves out of the relevant locator slot 111 (see FIG. 2), thereby freeing the cylinder 7 for rotation about its axis.

As also illustrated in FIG. 5, the pawl actuating shaft 35 also has an upwardly inclined portion. At this stage in the movement, i.e. when the locator 40 moves out of the relevant slot 11, the upwardly inclined portion of the shaft 35 cams the pawl 32 upwardly against the, bias of the pawl spring 33. As illustrated particularly clearly in FIG. 7, the lower end of the pawl 32 has a hook-like formation which engages the relevant one of a series of sprocket pins 52. The upward movement of the pawl therefore pulls the relevant pin 52 upwardly and rotates the cylinder 7 through one sixth of a full rotation, i.e. through 60°, thereby moving the succeeding cartridge cavity into alignment with the firing pin 25, i.e. with the axis 57, being the axis of the barrel, in preparation for the firing of the next shot.

Figure 10:
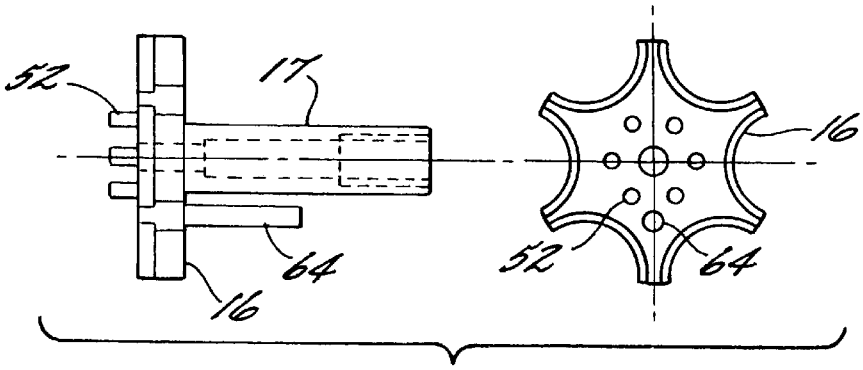
FIGS. 10 and 10A show front and side elevations of alternative extractor heads of the revolver.
Figure 10A:
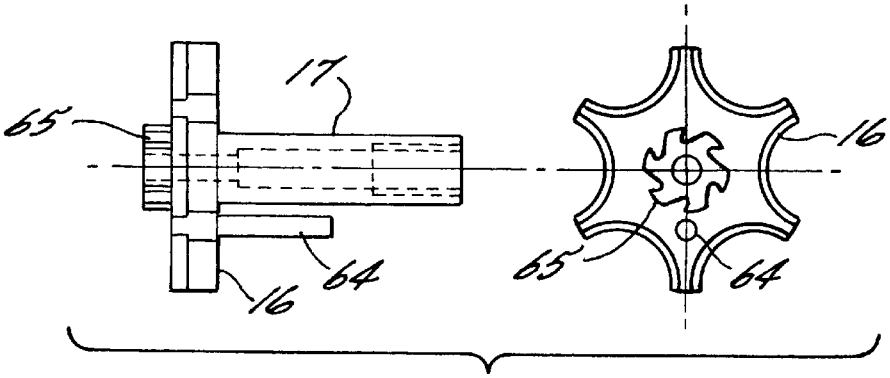

FIG. 10 shows side and rear elevation views of the sprocket pin assembly, and illustrates the positions of the pins 52. FIG. 10A shows an alternative design in which the pins 52 are replaced by a toothed sprocket wheel 65. It will be appreciated that in the arrangement of FIG. 10A, the teeth of the sprocket wheel 65 are successively engaged by the pawl 32, resulting in the same rotary indexing movement of the cylinder 7.

During the upward movement of the pawl 32, i.e. during rotary indexing of the cylinder 7, the downwardly inclined portion of the shaft 38 engages the screw 49 and locator 40, thereby camming the locator 40 downwardly under the influence of the locator spring 50. The lower end of the locator 40 engages in the succeeding holding slot 111 and positively anchors the rotational position of the cylinder 7 with the cartridge aligned on the axis 57.

When the hammer assembly is released i.e. when the shaft 56 is released and the hammer 28 flies forwardly, the shafts 35 and 38 spring back to their original positions as seen in FIG. 5. The pawl 32 and locator 40 are also returned to their FIG. 5 positions, urged respectively by the springs 33 and 50.

After firing as described above, the trigger assembly returns to its standby position as seen in FIG. 5. The hammer actuating lever 46 pivots anticlockwise about the trigger link pin 43, permitting it to move to the left past the shaft head 56.

Figure 7:
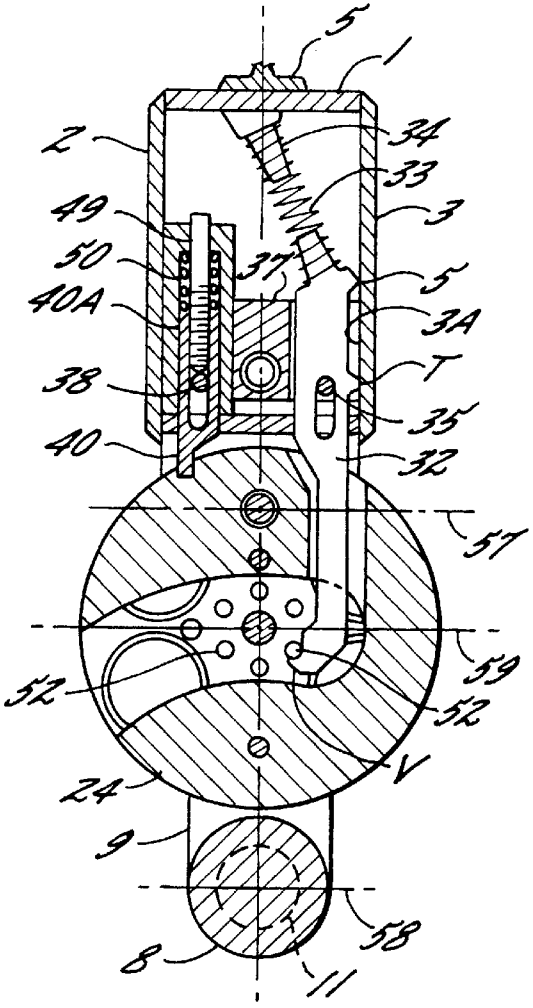
FIG. 7 shows a cross-section at the line G—G in FIG. 4.
Figure 9:
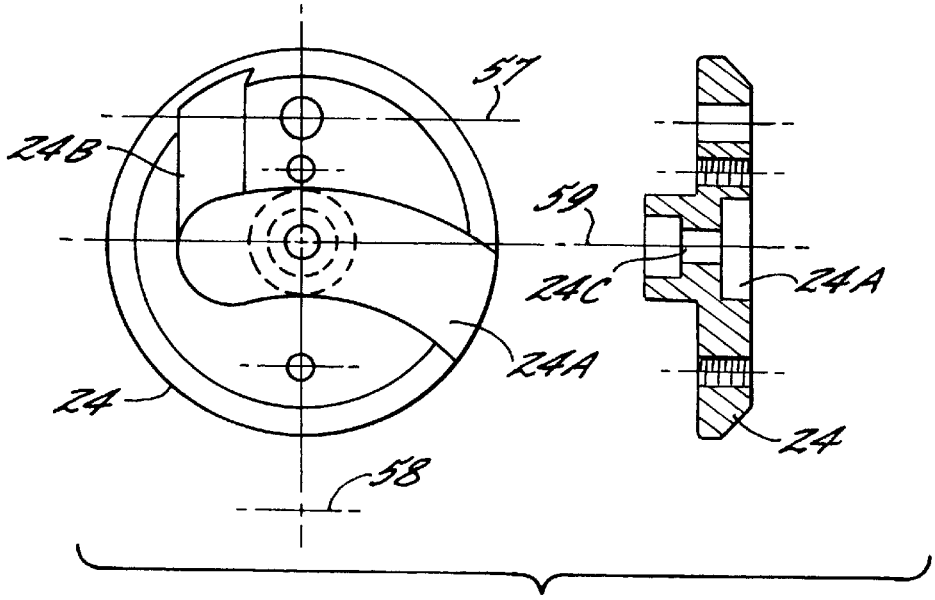
FIG. 9 shows elevation and cross-sectional views of the recoil disc of the revolver.

Referring to FIG. 7 it will be seen that the line of action of the pawl spring 33, which acts between the pawl spring anchor point 34 and the pawl 32, is at an angle to the central vertical plane of the revolver. The larger component of spring force acts downwardly and hence urges the pawl 32 in a downward direction onto the pawl actuating shaft 35. The smaller component of spring forces acts to the side and urges the contact points S and T into sliding engagement with the surface sliding area 3A of the right side plate of the revolver structure.

The sideways acting component of spring force exerts a clockwise (as viewed in FIG. 7) turning moment on the pawl about the tip of the contact point T. This feature tends to keep the lower end of the pawl 32 firmly engaged with the relevant sprocket pin 52 while the system is stationary and during the upward movement of the pawl which causes the cylinder 7 to index rotationally. During return, downward movement of the pawl 32 after completion of the rotary indexing operation, the sloping surface V at the lower end of the pawl deflects the lower end of the pawl to the right and allows it to clear the next succeeding sprocket pin 52. After clearing the next pin 52, the pawl 32 pivots anticlockwise (as viewed in FIG. 7) about the tip of the contact point T and snaps into position beneath the pin, ready for a repetition of the procedure when next the revolver is fired.

A description is now given of the cartridge cylinder assembly. This assembly includes the cartridge cylinder 7, extractor head 16, extractor body 17, extractor rod 15, cylinder retainer spring 18, centre pin 14, centre pin retainer spring 19, sprocket pins 52, yoke 9, yoke pivot shaft 11 and yoke retaining pin 10.

The cartridge cylinder assembly can pivot about the centre line or axis 58 of the yoke pivot shaft 11. During normal operation, the assembly is held in the operative position, as seen in FIG. 5, by engagement of the locking bolt 20 in the end of the extractor rod 1 5 and by engagement of the opposite end portion 14A of the centre pin 14 in the central hole 24C of the recoil disc 24 (see FIGS. 5 and 9).

To release the assembly for rotation about the axis 58, the cylinder latch button 12 is depressed by finger action. This pushes the centre pin 14 to the left and frees the end portion 14A thereof from the hole 24C. Simultaneously, the movement of the centre pin 14 to the left pushes the locking bolt 20 out of the end of the extractor rod 15. The cartridge cylinder assembly is now free to rotate about the axis 58. Spent cartridge cases are ejected from the cartridge cavities of the cylinder by pushing the extractor rod 15, and hence the attached extractor head 16, to the right, and new cartridges can be inserted into the cartridge cavities. Once loaded as required, the cylinder assembly is swung back about the axis 58 and automatically clips into position ready for firing. During such clipping, the locking bolt 20 is moved to the left against the bias of the spring 22 which, after alignment of the extractor rod 15 with The locking bolt 20, urges the locking bolt to the right so as to locate in the end of the extractor rod and simultaneously causing the portion 14A of the centre pin 14 to locate once more in the hole 24C.

Figure 6:
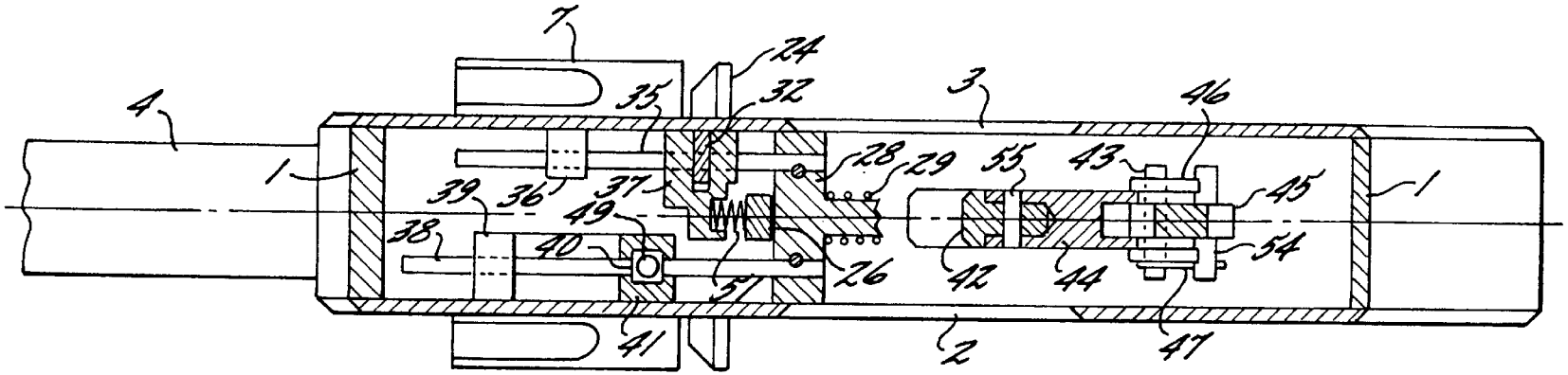
FIG. 6 shows a cross-section at the line E—E in FIG. 4.
Figure 13:
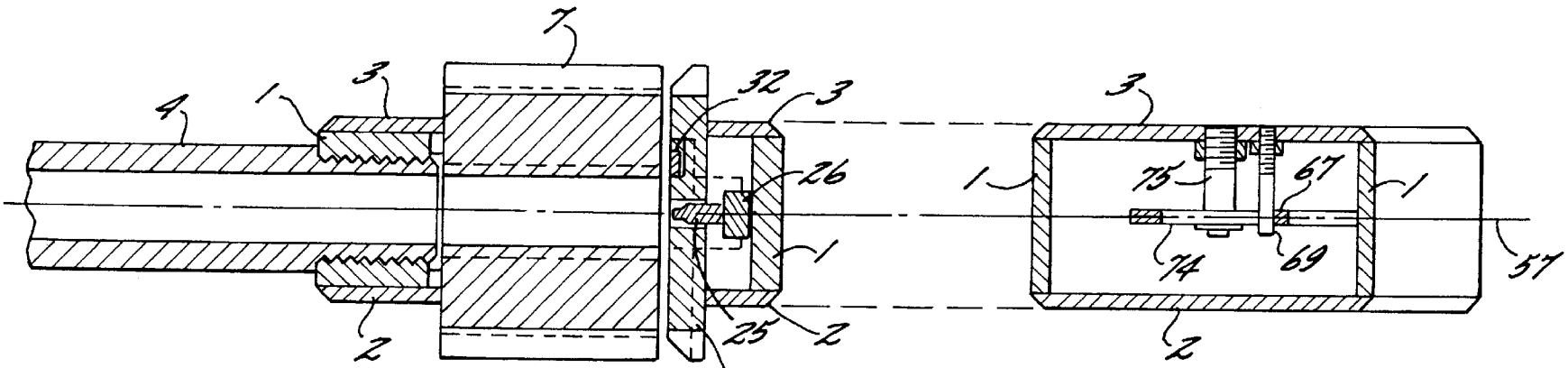
FIG. 13 shows a cross-sectional view at a line corresponding to the line F—F in FIG. 4, of the version seen in FIG. 12.
Figure 8:
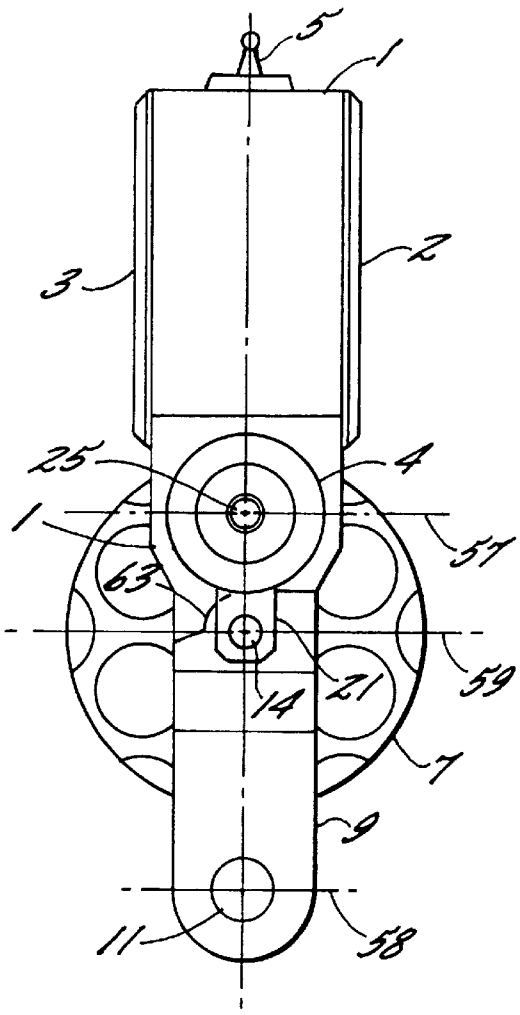
FIG. 8 shows a front elevation of the revolver of FIG. 4.
Figure 14:
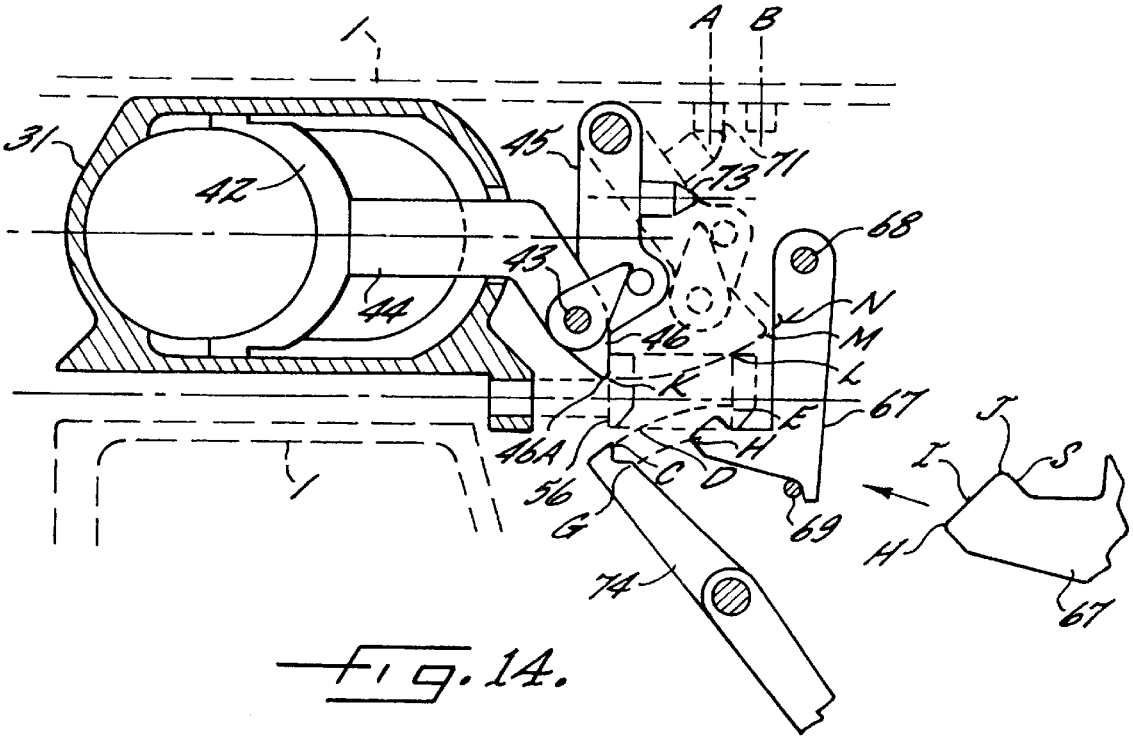
FIG. 14 illustrates the trigger system of the version of FIGS. 12 and 13, at an enlarged scale.
Figure 12:
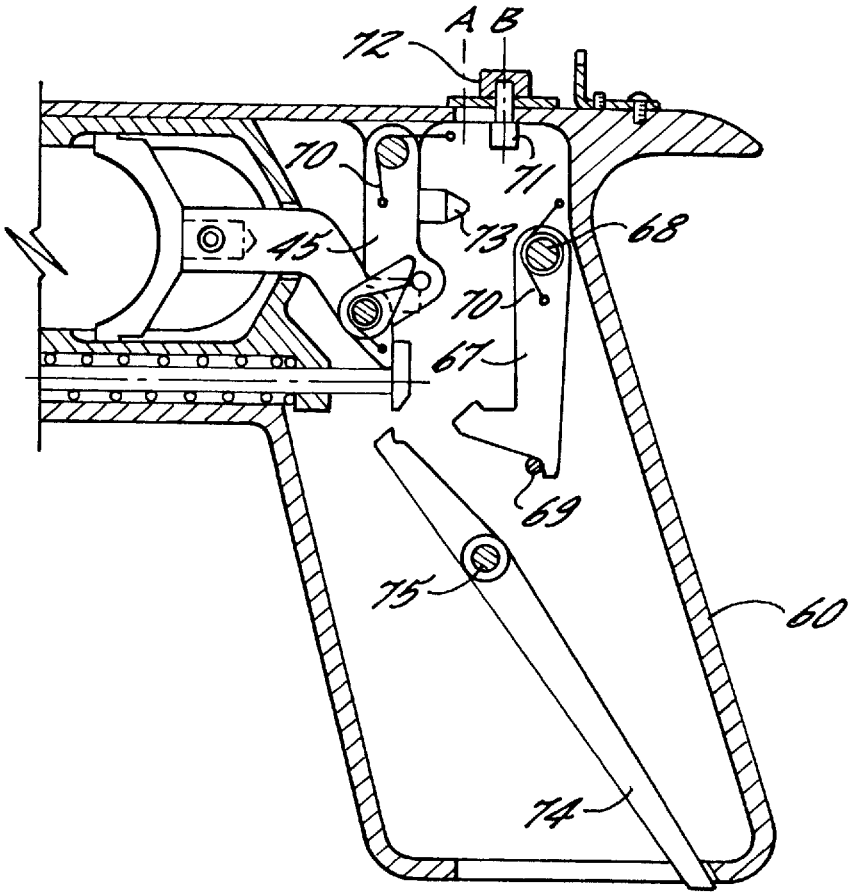
FIG. 12 shows a cross-sectional view of the butt of a modified version of the invention.

FIGS. 5, 6 and 11 illustrate the revolver in a form in which firing will take place as soon as the trigger 42 is pulled back far enough for the hammer actuating lever to move clear of the shaft head 56. FIGS. 12, 13 and 14 illustrate an arrangement with the facility for cocking of the weapon.

The numerals in these Figures indicate the following:

67. a cocking lever
68. a pivot pin
69. a stop
70. a spring
71. a moveable stop
72. a knob
73. a stud which is rigidly attached to the trigger link lever 45
74. an uncocking lever
75. a pivot pin The cocking operation is as follows. At a certain position when the hammer shaft head 56 is pulled back by the action of the lever end 46A, the head 56 contacts a sliding surface I of the lever 67. This causes the lever 67 to swing in an anticlockwise direction (as illustrated in FIGS. 12 and 14) until such time as the head 56 slips past a raised portion J on the lever 67. This takes place before the lever end 46A releases the shaft head 56. Further rearward movement of the trigger 42 results in the lever end 46A releasing the shaft head 56 at the point L, but the head 56 is prevented from spring back by the restraining surface S of the lever 67 which engages it. In this condition, the revolver is cocked.

Further rearward movement of the trigger 42 and hence of the lever end 46A swings the lever 67 further in the anticlockwise direction such that the surface S is moved clear of the head 56. The head 56 and hammer assembly is now free to move forwardly to achieve firing as described previously.

In the event that it is required to cock the weapon and avoid inadvertent firing of a shot, the moveable stop 71 is slid forwardly to the position indicated by the letter A. In this position, a stud 73 on the trigger link lever 45 engages the stop 71 and prevents movement of the lever end 46A to a position in which the shaft head 56 is released and firing can take place. When it is then required to fire the revolver from the cocked position, the stop 71 is slid back to the position B, thus permitting the trigger to be pulled back far enough for the lever end 46A to release the shaft head 56.

In order uncock the weapon from the cocked position as described above, the uncocking lever 74, which is accessible through the lower end of the butt, is pushed forwardly. This brings the end point C (FIG. 14) of this lever to a position in which it is in the path of forward movement of the shaft head 56. Further forward movement of the lever 74 causes the contact surface G of the lever to contact and then push back the lever 67. This releases the shaft head 56 which is nevertheless restrained by the end point C of the lever 74. The lever 74 can now carefully be returned to its normal position, thereby allowing the hammer assembly to return to the normal position with insufficient momentum to cause firing of the revolver. The revolver is now uncocked and ready for a normal firing operation.

Referring to FIG. 2 the revolver includes an external lever 200 which operates an internal safety catch (not illustrated). When the lever 200 is flipped to a safety on position, the internal catch prevents rearward movement of the trigger link pin 43 and hence prevents the trigger 42 from being pulled and the weapon from firing.

In the embodiments of revolver illustrated in FIGS. 4 to 14 the particular layout of the internal mechanical components is such as to enable the mounting of the trigger 42 above the axis of the barrel, i.e. the line along which the recoil of the weapon will act on firing. This is considered to be an extremely important feature of the invention since, inter alia, it allows for a mass distribution that, as described previously, reduces the tendency of the weapon to jerk upwardly when fired.

Figure 15:
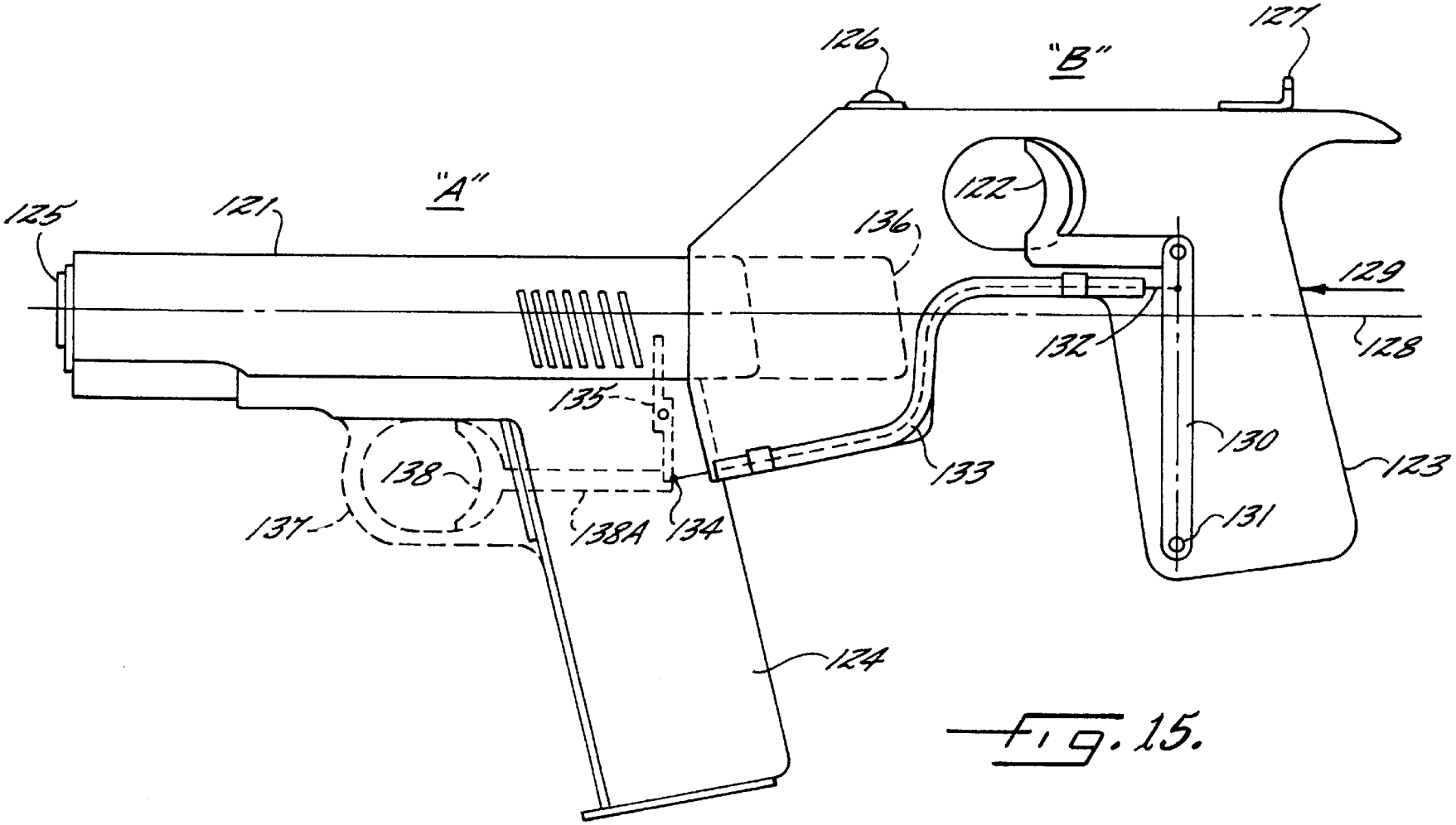
FIG. 15 diagrammatically illustrates another embodiment of the invention, in this case applied to an automatic pistol.

The embodiments described above are of a revolver version of the invention. However, as stated at the outset, the invention is equally applicable to handguns in the form of automatic pistols. FIG. 15 illustrates a pistol version of the invention in which the principles of the invention are applied to an existing, slightly modified pistol. In FIG. 15, the numerals indicate the following:

121. the sliding piece of the weapon
122. a trigger
123. a butt
124. a cartridge magazine
125. a barrel
126. a front sight
127. a rear sight
128. the centre line or axis of the barrel
129. the line of action of the resisting force applied by the shooter's hand
130. a lever
131. a pivot pin
132. an actuating cable
133. a cable sheath for the cable 132
134. the actuating point on the disconnector 135
135. a disconnector
136. the position to which the sliding piece 121 moves when the weapon is fired
137. the previous position of the trigger guard (which has been removed)
138. the previous position of the trigger (which has been repositioned)
138A. the extension of the trigger 138.

It will be seen that, in accordance with the underlying principle of the invention, the lines 128 i.e. the line of action of the recoil force on firing, and 129, i.e. the Line of action of the resisting force, are substantially coincident, thereby greatly reducing the tendency of the weapon to jerk upwardly. As in FIG. 2, and for the same reasons, the line 129 is in fact slightly above the line 128.

The letter A in FIG. 15 indicates a conventional automatic pistol, typically a Colt, Model 1911 which has been modified to permit attachment of the components indicated with the letter B. Those skilled in the art will be familiar with the normal operation of the unmodified weapon for present purposes, it is suffices to say that, in the unmodified pistol A, firing is achieved by pulling the trigger 138. This causes the trigger extension 138A to move to the right. The trigger extension is attached to the disconnector 135 which accordingly pivots anticlockwise (as viewed in FIG. 15). This in turn initiates the firing action.

With the pistol modified as illustrated, and the addition of the components B in accordance with the invention, firing is achieved by pulling the trigger 122. This causes pivotal movement of the lever 130. The lever 30 pulls on the attached cable 132. Traction on the cable 132 pulls the lower end of the disconnector to the left, once again initiating the firing action.

As an alternative to the use of a cable 132 as just described, it would be equally feasible to use a mechanical linkage.

Figure 16:
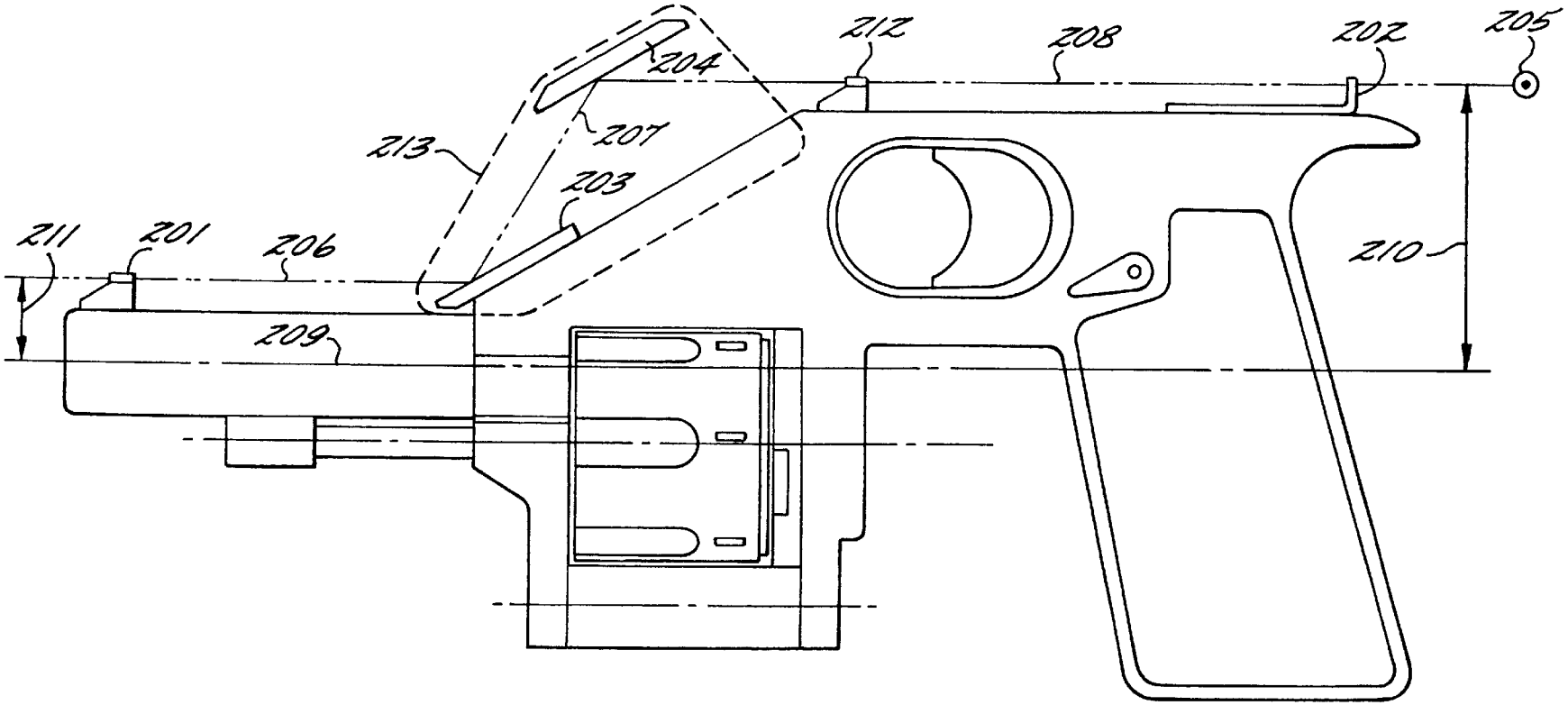
FIG. 16 shows another modification of the revolver seen in FIG. 2.

FIG. 16 illustrates a modified form of revolver, similar in all other respects to the revolver of FIG. 4, designed to improve the aiming of the weapon. In conventional handguns, the aiming line through the sights is generally of the order of 15 mm above the centre line of the barrel. With the revolver seen in FIGS. 2 and 4, it is anticipated that the aiming line will typically be about 25 mm above the centre line of the barrel. This will not adversely affect the aiming of the weapon as long as appropriate sight adjustments are made prior to firing.

However, if required, the misalignment of the aiming line and the centre line of the barrel may be largely eliminated with the use of a double mirror or prism system as illustrated in FIG. 16.

In FIG. 16, the numerals indicate the following:

201. front sight
202. rear sight
203 and 204. mirrors
205. the shooter's eye
206, 207 and 208. line of sight from the eye 205 to the target
209. centre line of the barrel
210. distance of line of sight from the centre line 209
211. distance of the deflected line of sight 206 from the centre line 209
212. the position at which the front sight of an unmodified gun of FIG. 4 type would normally be situated.
213. a frame for locating and mounting the mirrors 203 and 204. The frame and mirrors may be integral with the weapon or a detachable unit.

FIG. 16 is largely self-explanatory, and it will be seen that a person using the weapon will see the target along the line of sight 208, the light rays having been twice deflected by the mirrors 203 and 204. Thus the user's line of sight is effectively along the line 206, at a small distance 211 only from the centre line of the barrel. A further advantage which arises from this arrangement is the fact that the length of the line of sight between the front sight 201 and the rear sight 202 is substantially increased compared to a normal line of sight between, say, the front sight 212 and the rear sight 202, thereby improving aiming accuracy.

Figure 3:
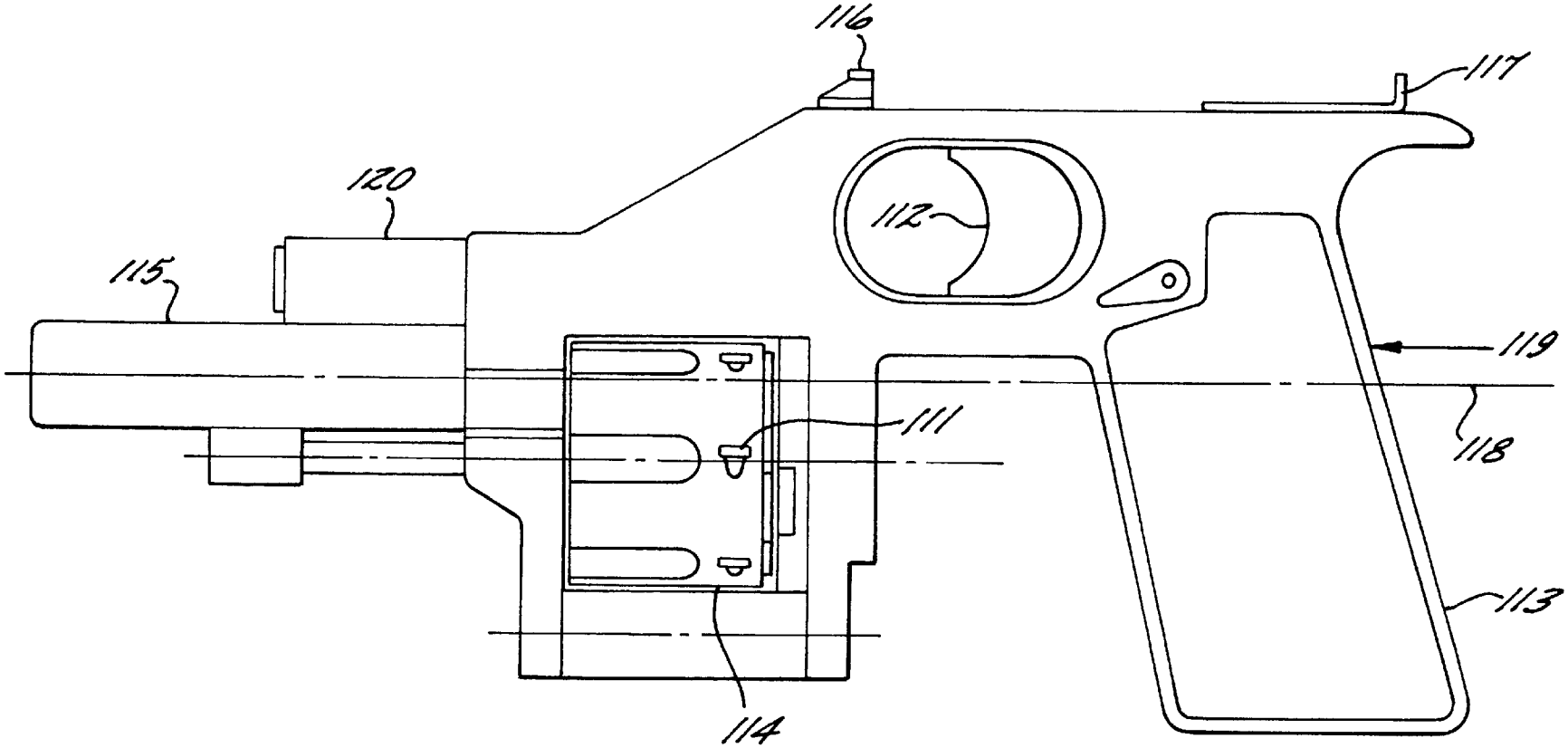

FIG. 3 also illustrates a revolver, similar to those of FIGS. 2 and 4, which has been modified to improve aiming accuracy. In this case, a small laser tube or laser diode 120 has been mounted on the barrel. In use, the laser tube emits a laser beam which, when it falls on the target, will indicate correct aiming of the barrel at the target. The laser beam may be parallel to the axis of the barrel, but is preferably slightly downwardly inclined with respect to that axis so as to impinge, for a given distance from the handgun at the same location on the target as a bullet which is fired from the handgun. The beam direction may be adjustable to enable the handgun to be zeroed for different distances.

I claim:

1. A handgun in the form of a revolver which comprises a trigger, a firing mechanism arranged to be actuated by the trigger and to fire a cartridge, a barrel through which the bullet of the cartridge is projected when the cartridge is fired, the barrel having an axis, and a butt which is arranged to be gripped in the hand of a user, wherein the axis of the barrel, and hence the line of action of a recoil force which is generated when the cartridge is fired, is at least substantially aligned with the line of action of a resisting force applied to the revolver by the user's hand when the butt is gripped normally, wherein the trigger is located above the axis of the barrel, wherein the center of inertia of the revolver is located on or just above the axis of the barrel; and wherein the firing mechanism comprises a hammer which is arranged to cause movement of a firing pin in a direction to cause firing of the cartridge and which is carried by a spring loaded hammer shaft actuated by the trigger, the hammer shaft lying on an axis below the trigger and substantially coincident with the line of action of the resisting force.

2. The handgun according to claim 1 wherein the axis of the barrel is located slightly below the line of action of the resisting force.

3. The handgun according to claim 2 wherein the butt is inclined relative to the axis of the barrel at such an angle that the axis of the barrel passes substantially through the wrist joint of said user when said user holds the butt in the normal manner.

4. The handgun according to claim 1 comprising a laser tube or laser diode arranged to project a laser beam parallel to or at an oblique angle to the axis of the barrel.

5. The handgun according to claim 1 comprising a front sight on the barrel, a rear sight located towards the rear of the handgun, the front sight being located beneath the rear sight, and an arrangement of reflectors arranged to provide an aiming line close to the axis of the barrel and passing through the front and rear sights.

6. The handgun according to claim 1 wherein the butt is inclined relative to the axis of the barrel at such an angle that the axis of the barrel passes substantially through the wrist joint of said user when said user holds the butt in the normal manner.

* * * * *